US005390007A

United States Patent [19]

Kugoh et al.

[11] Patent Number: 5,390,007

[45] Date of Patent: Feb. 14, 1995

[54] CHARGING MEMBER, CHARGING DEVICE, PROCESS CARTRIDGE AND IMAGE FORMING APPARATUS

[75] Inventors: Harumi Kugoh, Kawasaki; Junji Araya; Hideyuki Yano, both of Yokohama, all of Japan

[73] Assignee: Canon Kabushiki Kaisha, Tokyo, Japan

[21] Appl. No.: 18,284

[22] Filed: Feb. 16, 1993

[30] Foreign Application Priority Data

Feb. 13, 1992 [JP] Japan ..... 4-059496

[51] Int. Cl.[6] ..... G03G 15/02

[52] U.S. Cl. ..... 355/219; 361/221; 361/225

[58] Field of Search ..... 355/217, 219, 200, 296; 361/221, 225, 230; 118/653; 271/243

[56] References Cited

U.S. PATENT DOCUMENTS

| | | | |
|---|---|---|---|
| 3,789,278 | 1/1974 | Bingham et al. | 361/230 X |
| 3,832,055 | 8/1974 | Hamaker | 355/274 |
| 3,845,951 | 11/1974 | Hamaker | 271/243 |
| 4,066,352 | 1/1978 | Kameda et al. | 355/217 |
| 4,309,803 | 1/1982 | Blaszak | 355/219 X |
| 4,444,864 | 4/1984 | Takahashi | 118/653 X |
| 5,038,174 | 8/1991 | Kato et al. | 355/215 |
| 5,068,691 | 11/1991 | Nishio et al. | 118/653 X |
| 5,229,813 | 7/1993 | Cherian | 355/200 |
| 5,241,343 | 8/1993 | Nishio | 355/219 |
| 5,243,387 | 9/1993 | Ikegawa | 355/219 |

FOREIGN PATENT DOCUMENTS 63-149669 6/1988 Japan .

*Primary Examiner*—Matthew S. Smith
*Assistant Examiner*—Shuk Y. Lee
*Attorney, Agent, or Firm*—Fitzpatrick, Cella, Harper & Scinto

[57] ABSTRACT

A charging member contactable to a member to be charged to electrically charge it includes a sponge layer; a coating layer disposed between the sponge layer and the member to be charged; wherein a cell diameter in a surface of the sponge layer coated with the coating layer is not more than 200 microns.

60 Claims, 2 Drawing Sheets

CHARGING MEMBER, CHARGING DEVICE, PROCESS CARTRIDGE AND IMAGE FORMING APPARATUS

FIELD OF THE INVENTION AND RELATED ART

The present invention relates to an image forming apparatus such as a copying machine or laser beam printer, a process cartridge suitably usable therewith, a charging device suitably usable therewith and a charging member suitably usable therewith in which a contact type charging device is preferably used by which a charging member supplied with an oscillating voltage is contacted to a member to be charged such as a photosensitive drum to electrically charge or discharge it.

Heretofore, as for a charging device for an image forming apparatus such as a copying machine or the like, a corona charger has widely been used. However, the corona charger involves drawbacks that a high voltage is required and that amount of ozone production is relatively large.

To avoid these drawbacks, a contact type charging system using a conductive charging roller, blade or the like, has recently been put into practice. Unlike the corona charger, this system does not require a large voltage source, and ozone is hardly produced. The charging mechanism of the contact type charging system is such that the electric discharge in the gap between the charging member and the member to be charged is dominant rather than the charge injection from the charging member to the member to be charged through the contact portion. The electric charge is produced by applying to the charging member a DC voltage which is higher than the charge starting voltage, and therefore, the member to be charged is charged.

The charging can be made uniform by applying an oscillating voltage which is in the form of an AC-biased, DC voltage, the DC voltage corresponding to the target potential. More particularly, as disclosed in Japanese Laid-Open Patent Application No. 149669/1988, the oscillating voltage has a peak-to-peak voltage which is twice as high as the charge starting voltage for the member to be charged when only a DC voltage is applied to the charging member, and then, the charging of the member to be charged is uniform.

Heretofore, the contact type charging member has generally been in the form of a solid charging roller or charging blade made of electroconductive rubber, in consideration of the fact that if the surface of the charging member has surface defects such as pits and projections, the charging becomes non-uniform. However, in this case, it is difficult to lower the roller hardness, and therefore, a problem of charging noise arises.

The charging noise is produced when the voltage applied to the charging device contain an oscillating component, since then an oscillating electric field is formed between the charging device and the member to be charged, so that they vibrate with the result of noise. By reducing the hardness of the charging member, this problem can be reduced, but it is difficult when the solid rubber roller is used.

In consideration of the above, a charging roller comprises a base layer of soft foamed material (sponge-like material containing foamed cells) in place of the solid rubber roller, and a surface layer (coating layer) for providing smooth surface, thus decreasing the hardness of the charging member.

The foamed material is usually in the foam of a conductive rubber layer made of NBR (nitrile butadiene rubber), urethane, EPDM (terpolymer of ethylene propylene diene) in which conductive material such as carbon black is dispersed. The foamed material is in the foam of a cylinder fixed on the surface of the rotating shaft, and the foamed material is coated with a high resistance coating layer, thus constituting a charging roller. The high resistance coating layer is provided since otherwise if the member to be charged has a pin hole, the charging current flows concentrated to the pin hole with the result that the entire potential of the charging roller decreases so that a linear improper charging portion occurs.

However, a non-uniform charging still occurs with this charging roller. In order to increase the uniformity, it will be a solution that the peak-to-peak voltage is increased. However, as described above, this would result in increasing the noise.

SUMMARY OF THE INVENTION

Accordingly, it is a principal object of the present invention to provide a charging member, a charging device, a process cartridge and an image forming apparatus wherein hardness of the charging member is decreased so that the charging noise level is decreased.

It is another object of the present invention to provide a charging member, a charging device, a process cartridge and an image forming apparatus in which the surface of the charging member is made smooth so that the uniform charging can be effected.

It is another object of the present invention to provide a process cartridge and an image forming apparatus capable of providing high quality images.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The embodiments of the present invention will be described in detail in conjunction with the accompanying drawings.

Figure 1:
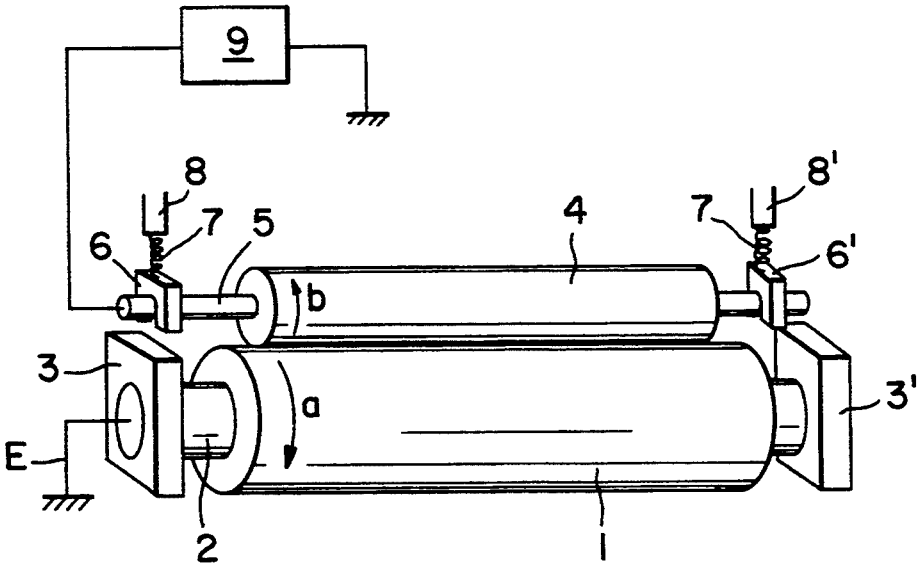
FIG. 1 is a perspective view of a charging device mounted in an image forming apparatus.

Referring to FIG. 1, there is shown an image forming apparatus such as a copying machine provided with a charging device according to an embodiment of the present invention.

The member to be charged in the form of a OPC photosensitive drum 1 is rotatably supported by a shaft 2 supported by bearings 3 and 3'. The shaft 2 is electrically connected to an electroconductive base made of aluminum or the like which supports a photosensitive layer of the photosensitive drum 1, and is electrically grounded (E).

Figure 7:
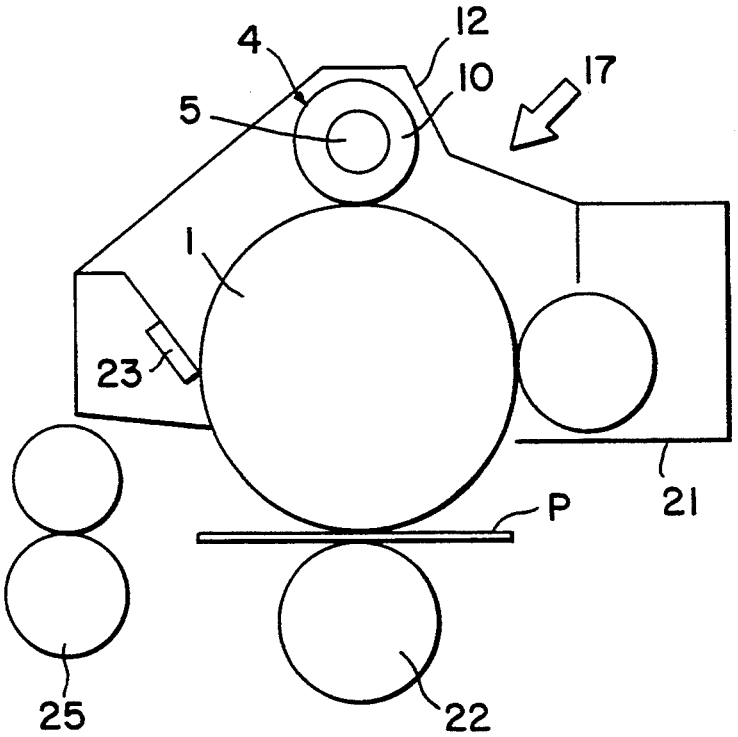
FIG. 7 is a longitudinal sectional view of a printer having the charging roller.

To the surface of the photosensitive drum 1, (the surface to be charged), a charging member in the form of a changing roller 4 is contacted. The charging roller 4 is rotatably supported by a pair of bearings 6 and 6' by a conductive rotational shaft 5 made of metal or the like. It is urged by a coil spring 7 fixed on a fixed member 8, 8' to the photosensitive drum 1 at a predetermined pressure. Voltage source 9 applies a charging voltage to the charging roller 4 through a conductive rotational shaft 5. FIG. 7 shows a general arrangement of a printer having the charging roller 4. In this printer, the photosensitive drum 1 is made of OPC (organic photoconductor) applied on an aluminum drum having a diameter of 30 mm. An image forming operation is carried out on the photosensitive drum 1 at a process speed of 95 mm/sec.

The voltage applied to the charging roller 4 is an oscillating voltage in the form of an AC-biased, DC voltage in which a DC voltage corresponds to the desired dark portion potential Vd, and the AC voltage has a peak-to-peak voltage of 2000 V for uniform charging. By the AC charging, it becomes possible that the surface of the photosensitive drum 1 is uniformly charged to a potential Vd irrespective of the ambient condition change or the contamination of the charging roller.

After being uniformly charged by the charging roller 4, the photosensitive drum 1 is electrically discharged at the portion exposed to image light of a laser beam 17 modulated in strength in accordance with the image signal. In a developing station, a developing device 21 effects reverse-development with one component magnetic toner to visualize the portion exposed to the light, with toner. In this embodiment, the developing process is a jumping development type.

The toner image is transferred onto a transfer material P by a transfer roller 22 of the next station, that is, an image transfer station. In the printer of this embodiment, the charging device is in the form of a transfer roller 22 supplied with 3 KV voltage, as a charging device for the transfer.

The residual toner remaining on the photosensitive drum after the image transfer, is removed by a cleaner 23 having a counter blade of urethane rubber. The toner image on the transfer material P is fixed by a heating fixing device 23, and is finally discharged to outside of the apparatus.

In the above structure, when the photosensitive drum 1 of FIG. 1 is rotated in a direction of arrow a in FIG. 1 by an unshown driving means, the charging roller 4 is rotated thereby in a direction b while it is being in contact with the photosensitive drum 1 at a predetermined pressure. By application of a voltage from a voltage source 9 to the charging roller 4, the surface of the photosensitive drum 1 is uniformly charged. As an example of the voltage application, it may be in the form of a DC (−700 V) biased AC (peak-to-peak voltage of 1500–2500 V and a frequency of 550 Hz). Then, the surface of the photosensitive drum is charged to approx. −700 V. Here, the oscillating voltage is a voltage having a periodically changing voltage level, and the waveform thereof may be a sine wave, triangular wave, rectangular wave or the like. The oscillating voltage may be a rectangular wave generated by repeating actuation and deactuation of the AC source.

The peak-to-peak voltage of the oscillating voltage is preferably not less than twice as high as a charge starting voltage for the member to be charged. the charge starting voltage being a voltage at which the charge starts when only a DC voltage is applied to the charging member and is increased. By doing so, the potential after the charging is made uniform. The charge starting voltage for the OPC photosensitive drum was approx. −600 V in this embodiment.

In this embodiment, a process cartridge detachably mountable to an image forming apparatus comprises a photosensitive drum 1, a charging roller 4, a developing device 21 and a cleaner 23. However, it may comprise at least a photosensitive drum 1 and a charging roller 4.

Embodiment 1

Figure 2:
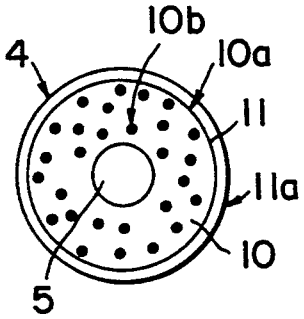
FIG. 2 is a sectional view of a charging roller according to a first embodiment of the present invention.

As shown in FIG. 2, the charging roller 4 comprises an electroconductive rotational shaft 5 (core member), a cylindrical lower layer 10 (foamed material 10) of foamed material (conductive sponge) which is of foamed EPDM or the like in which conductive material such as carbon black is dispersed. In addition, a surface coating layer 11 is provided. Here, the resistivity of the foamed material of the lower layer 10 is $10^5$–$10^7$ ohm.cm (250 V), and the resistivity of the coating layer 11 is larger than that of the lower layer and is $10^7$–$10^{10}$ ohm.cm (250 V). The lower layer 10 contains foamed cells (cavities or pores). At the surface 10*a* thereof, the maximum cell diameter is not more than 200 microns, and therefore, the surface 11*a* of the charging roller after coated with the coating layer 11 has a smooth surface.

The charging uniformity by the charging roller 4 will be compared in Table 1 between when the cell diameter at the surface 10*a* of the lower layer 10 is not more than 200 microns (100 microns) according to this embodiment and when the cell diameter is 300 microns (roller No. 2).

TABLE 1

| Rollers | Surface call size (μm) | Uniformity 1.5KV | Uniformity 2.0KV | Uniformity 2.5KV | Surface roughness (μm) |
|---|---|---|---|---|---|
| 1 | 100 | F | G | G | 18.3 |
| 2 | 300 | N | N | F | 63.8 |

G: Good
F: Fair
N: No good

In the experiments, the diameter of the shaft 5 was 6 mm, and the diameter of the roller was 12 mm. The lower layer of the used charging roller is of sponge of EPDM in which carbon is dispersed, and the surface is polished. The coating layer 11 was of acrylic resin in which conductive filler (titanium bioxide of 35% by weight) and was applied thereon. The lower layer 10 may be of silicone rubber BR (butadiene rubber). UR, IR or the like. The coating layer 11 may be of urethane resin in which titanium monoxide (50% by weight) is dispersed. Between the lower layer 10 and the coating layer 11, a primer layer may be provided to enhance the bonding strength. In addition, further on the coating layer 11, a protection layer may be formed in order to prevent contamination of the photosensitive drum 1. The charging roller 4 thus produced was subjected to the resistance measurement in which the outer surface thereof is wrapped with a metal tape having a width of 1 cm, and the resistance between the metal tape and the shaft 5 was measured. The results were as follows:

Roller No. 1 (cell diameter of 100 μm): $3\times10^5\ \Omega$

Roller No. 2 (cell diameter of 300 μm): $3\times10^5\ \Omega$.

The surface configuration of the charging roller 4 after the coating was as follows:

Roller No. 1 Rz (surface roughness): 10.3 μm

Roller No. 2: 63.8 μm

The surface roughness was determined under JIS B0651 and was ten point average roughness in a 2.5 mm length by a contact needle surface type roughness measuring device. As will be understood, the surface of the roller No. 2 is quite rough.

The charging conditions in the experiment were as described above except for the AC voltage. As will be understood from Table 1, the roller No. 1 provides good results with the AC voltage of 1.5 KV applied, and further better images were produced with 2.0 KV. Since the roller No. 1 has a hardness lower than the conventional solid charging roller, and the charging noise was lower than the conventional solid roller. However, the roller No. 2 was not satisfactory in the image quality even if 2.5 KV was applied. The configuration of the charging member is not limited to the roller as in the charging roller 4, but may be in the form of a blade (fixed type) or in the form of a belt (rotatable type).

The surface roughness Rz of the charging member is preferably not more than 50 microns from the standpoint of uniformity of the charging.

Embodiment 2

Figure 3:
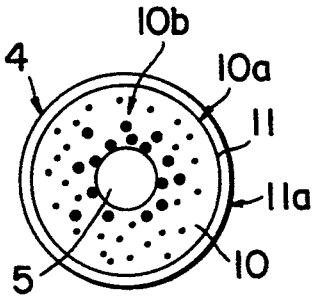
FIG. 3 is a sectional view of a charging roller according to a second embodiment of the present invention.

Similarly to the foregoing embodiment, the charging roller comprised a core metal in the form of a conductive rotational shaft 5 of FIG. 3, electroconductive sponge (foamed material) 10 of foamed EPDM or the like in which conductive material such as carbon black is dispersed, on the core material, and a coating layer 11 of urethane material in which 50% by weight of titanium monoxide is dispersed. In the surface 10*a* of the foamed material 10, there is no cell, or, if any, the cell diameter is sufficiently smaller than the cell diameter in the inside 10*b* of the foamed material 10 (skin). The cell diameter of the surface 10*a* of the foamed material 10 is not more than 200 microns.

By doing so, the surface 11*a* of the charging roller 4 is smoother than in the first embodiment. The uniform charging property of the charging roller 4 of this embodiment is shown in Table 2 below.

TABLE 2

| Rollers | Surface call size (μm) | Uniformity 1.5KV | 2.0KV | 2.5KV | Surface roughness (μm) |
|---|---|---|---|---|---|
| 3 | 10.5 | E | E | E | 6.97 |

E: Excellent

The various conditions of the experiments are the same as in Embodiment 1. The surface roughness of roller No. 3 was very low (Rz=6.97 microns). Thus, the further uniform charging property can be provided with lower AC voltage (1.5 KV) than in the first embodiment. The hardness is sufficiently low to be effective to prevent the charging noise.

Embodiment 3

Figure 4:
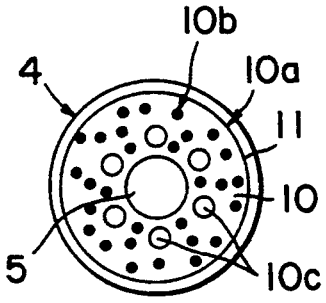
FIG. 4 is a sectional view of a charging roller according to a third embodiment of the present invention.

In this embodiment, similarly to the foregoing embodiment, the charging roller 4 comprised the core metal of conductive shaft 5 as shown in FIG. 4, a foamed material 10 thereon which is a foamed EPDM or the like in which carbon black or the like is dispersed. It is further coated with a top coating layer. Here, the inside 10*b* of the foamed material 11, as shown in FIG. 4, has a number of longitudinal through holes 10*c* distributed circumferentially or helical through holes. By doing so, the hardness of the roller is lowered to reduce the charging noise. The diameter of the through holes 10*c* is 0.5–1 mm. The surface 10*a* of the foamed material 10 has cell diameters of not more than 200 microns, or it is the skin surface.

Embodiment 4

In this embodiment, the porosity which will be described hereinafter, of the foamed material is not less than 50%.

The rotating shaft 5 is in the form of a core metal having a diameter of 6 mm and also functions as the electric current supply path to the surface of the charging roller 4. The material of the foamed material 10 is EPDM, and carbon black is dispersed to give the electroconductivity. In order to give the conductivity sufficient to provide the good images. the rubber hardness is not permitted to be lower than 50 degrees (JIS A hardness). The EPDM material was foamed and molded and abraded. It was coated with the same coating layer as in the first embodiment, so that a charging roller 4 having a diameter of 12 mm was produced. The cell diameter in the surface of the foamed material 10 was 100 microns. The charging roller 4 thus formed was wrapped with an metal tape having a width of 1 cm, and the resistance between the shaft 5 and the metal tape was measured, and it was $3\times10^6\ \Omega$cm.

In this embodiment, the foamed material 10 had the porosity of 65%, and the hardness as the roller was 28 degrees (Asker C (total weight of 500 g)).

Figure 5:
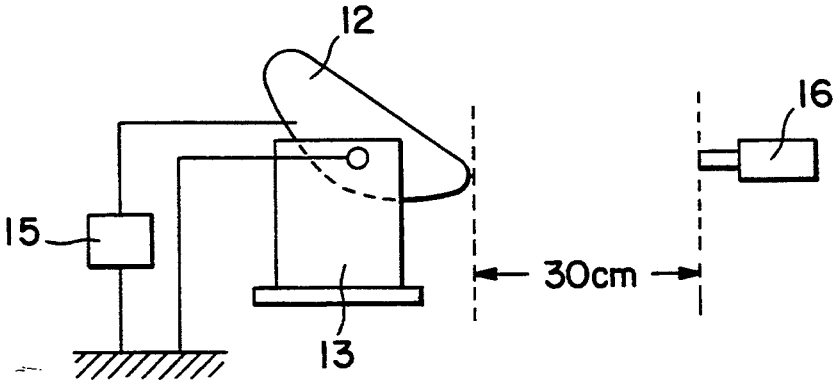
FIG. 5 illustrates a device for measuring the charging noise of a charging roller.
Figure 6:
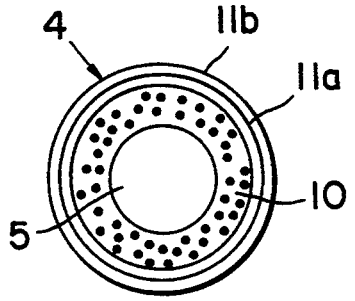
FIG. 6 is a sectional view of a charging roller according to a fifth embodiment of the present invention.

The charging roller 4 thus produced is inserted in a cartridge 12 shown in FIG. 5, and the charging noise was measured. In these experiments, in order to mainly measure the charging noise, the cartridge 12 was mounted on a rotating device 13, and a normal image forming voltage was applied externally. As shown in FIG. 6, the cartridge 12 and the noise meter 16 was spaced apart by 30 cm.

By the voltage source 15, the charging roller was supplied with an AC biased DC voltage in which the DC voltage component had −700 V, and the AC voltage component had a peak-to-peak voltage of 2000 V and a frequency of 550 Hz. In order to compare the charging noise, the measurements were carried out for rollers having different diameters, i.e., having different apparent hardnesses.

TABLE 3

| Rollers | Material | D.D. (mm) | 1) Hard. | 2) Por. (%) | 3) Form ratio | 4) Noise (dB) | 5) Feeling |
|---|---|---|---|---|---|---|---|
| 4 | EPDM sponge | 12ϕ | 28 | 65 | 2.86 | 48 | G |
| 5 | EPDM sponge | 12ϕ | 32 | 49 | 1.96 | 51 | F |
| 6 | EPDM sponge | 18ϕ | 20 | 65 | 2.86 | 49 | G |
| 7 | EPDM | 18ϕ | 22 | 48 | 1.96 | 52 | F |

TABLE 3-continued

| Rollers | Material | D.D. (mm) | 1) Hard. | 2) Por. (%) | 3) Form ratio | 4) Noise (dB) | 5) Feeling |
|---|---|---|---|---|---|---|---|
| 8 | sponge EPDM sponge | 12ϕ | 33 | 45 | 1.82 | 54 | F |

Roller No. 6 is a modification of roller No. 4 by increasing the diameter. Roller No. 7 is a modification of roller No. 5 by increasing outer diameter of roller No. 5.

1) Asker C hardness meter: total weight of 500 g

2), 3) Porosity is defined as (V2−V1)/V2 (ratio of air in the foamed material), and the foam ratio=V2/V1, where V1 is a volume of the material (rubber) before foaming, and V2 is a volume of the foamed material after the foaming.

4) Integrating sound level meter available from Rion (JIS C 1502)

5)

G: less than 50 dB

F: more than 50 dB and less than 55 dB

As shown in Table 3, if the comparison is made between roller No. 4 and roller No. 5, the porosity is higher in roller No. 4. and the noise is low. However, the hardness is also different, and therefore, it is not clear whether it is the effect of the porosity alone. If roller No. 4 and roller No. 7 are compared, the hardness of roller No. 7 is lower than roller No. 4, but the noise is higher. This difference results from the porosity difference, and because the porosity is higher in roller No. 4 than in roller No. 7, the noise is low.

The charging noise less than 50 dB is hardly sensed by a human being, but it is noisy if it exceeds 55 dB. Therefore, if the porosity of the foamed material is selected so as to be not less than 50%, the charging noise can be lowered enough not to be sensed by a human being.

A conventional solid roller having an outer diameter of 12 mm was subjected to the noise measurement, and was found to produce the charging noise close to 60 dB, which is quite noisy.

In this embodiment, the configuration of the charging member is roller, but it may be in the form of a blade, a block, belt or another.

Embodiment 5

In this embodiment, the charging roller 4, as shown in FIG. 6, foamed material 10 having a porosity of not less than 50% and a resistance layer 11 coated thereon. The resistance of the sponge roller without the coating layer is $7\times10^5$ Ω in the same measuring method as in the foregoing, and the volume resistivity of the material is approx. $7\times10^6$ Ω cm. A further resistance layer 11*a* was applied. It is of acrylic resin in which conductive filler (35% by weight tin oxide) is dispersed. The volume resistivity of the coating material in this state was approx. $5\times10^7$ Ω cm. The charging roller 4 is dip-coated with the above material to provide the resistance layer 11*a*. In this case, for the purpose of improving the bonding strength, the surface of the charging roller 4 is treated with primer and thereafter, the coating is carried out. After the resistance layer is coated, it may be further coated with a protection layer 11*b* has a surface layer (N-methoxymethyl nylon) for preventing of contamination of the photosensitive member. The resistance of the charging roller 4 thus produced was $4\times10^5$ Ω. The reasons for the coating of the charging roller surface are as follows.

(1) Prevention of improper charging due to a pin hole of the member to be charged, as described in the introductory part of this specification.

(2) Abraded surface of the charging roller 4 results in appearance of the non-uniformity of the resistance and the shape of the charging roller in the image. In order to prevent this, a high peak-to-peak voltage application is required. The coating is effective to stabilize the image without increase of the peak-lo-peak voltage.

(3) The resistance layer is coated rather than being formed as a tube, by which the thickness of the resistance layer can be reduced, and by which the cost can be reduced.

The cell diameter in the surface of the foamed material is 100 microns. In this embodiment, the foamed material 10 has a porosity of 65% and a hardness of 29 degrees (Asker C, total weight 500 g).

The charging roller 4 produced in this embodiment is mounted in a cartridge, and the charging noise was measured. The measuring conditions and methods are the same as described in the foregoing embodiment. The results are shown in Table 4. The outer diameters were all 12 mm.

TABLE 4

| Rollers | Material | 1) Hard. (mm) | 2) Por. | 3) Form (%) | 4) Noise ratio | 5) Feeling (dB) |
|---|---|---|---|---|---|---|
| 9 | EPDM sponge | 29 | 65 | 2.86 | 50 | G |
| 10 | EPDM sponge | 33 | 49 | 1.96 | 53 | F |
| 11 | EPDM sponge | 35 | 45 | 1.82 | 54 | F |

As shown in Table 4, rollers No. 9, 10 and 11 are modifications of rollers Nos. 4, 5 and 8 in the fourth embodiment by provision of the protection layer. As compared with rollers Nos. 4, 5 and 8, the hardness if higher by approx. 1 degree because of the coating of the resistance layer, and the noise level is higher. For example, roller No. 5 having exhibited 51 dB now exhibits 53 dB when it is coated (roller No. 10). The noise is increased slightly by the coating of the resistance layer on the surface, if the porosity is approximately equal to that of No. 9 roller, the noise is substantially at the satisfactory level even if it is coated.

In the foregoing embodiment, the coating layer on the sponge has preferably a thickness of not more than 500 microns since then the charging noise is not increased, and the charging efficiency is good (hardly any voltage drop through the coating layer).

While the invention has been described with reference to the structures disclosed herein, it is not confined to the details set forth and this application is intended to cover such modifications or changes as may come within the purposes of the improvements or the scope of the following claims.

What is claimed is:

1. A charging member contactable to a chargeable member to be charged to electrically charge the chargeable member, said charging member comprising:

a sponge layer; and a coating layer disposed between said sponge layer and the chargeable member;

wherein a cell diameter in a surface of said sponge layer coated with said coating layer is not more than 200 microns and wherein said sponge layer has a porosity of not less than 50%.

2. A charging device, comprising:

a charging member contactable to a chargeable member to be charged to electrically charge the chargeable member, said charging member including:

a sponge layer; and a coating layer disposed between said sponge layer and the chargeable member;

wherein a cell diameter in a surface of said sponge layer coated with said coating layer is not more than 200 microns and wherein said sponge layer has a porosity of not less than 50%.

3. A process cartridge detachably mountable to an image forming apparatus, said process cartridge comprising:

an image bearing member; and a charging member, contactable to said image bearing member, to electrically charge said image bearing member, said bearing member including a sponge layer and coating layer between said sponge layer and said image bearing member;

wherein a cell diameter in a surface of said sponge layer coated with said coating layer is not more than 200 microns and wherein said sponge layer has a porosity of not less than 50%.

4. A process cartridge according to claim 3, further comprising developing means for developing said image bearing member with toner.

5. An image forming apparatus, comprising:

an image bearing member; and a charging member, contactable to said image bearing member, to electrically charge said image bearing member, said charging member including a sponge layer and a coating layer between said sponge layer and said image bearing member;

wherein a cell diameter in a surface of said sponge layer coated with said coating layer is not more than 200 microns and wherein said sponge layer has a porosity of not less than 50%.

6. A member according to claim 1, wherein said coating layer is applied on said sponge layer.

7. (Amended) A member according to claim 1, wherein said coating layer has a thickness of not less than 50 microns.

8. An apparatus according to claim 5, wherein said charging member is supplied with an oscillating voltage.

9. An apparatus according to claim 8, wherein the oscillating voltage is an AC-biased, DC voltage.

10. An apparatus according to claim 8 or 9, wherein a peak-to-peak voltage of said oscillating voltage is not less than twice as high as a charge starting voltage for said image bearing member.

11. A member according to claim 1, wherein ten point average roughness of a surface of said charging member is not more than 50 microns.

12. A member according to claim 1, wherein said sponge layer is electrically conductive and the coating layer comprises a resistance layer.

13. A member according to claim 1, wherein said charging member comprises a roller.

14. A member according to claim 1 or 7, wherein said coating layer has a thickness of not more than 500 microns.

15. A member according to claim 1, wherein said coating layer is contactable to the chargeable member.

16. A charging member contactable to a chargeable member to be charged to electrically charge the chargeable member, said charging member comprising:

a sponge layer; and a coating layer disposed between said sponge layer and the chargeable member;

wherein a cell diameter in a surface of said sponge layer coated with said coating layer is not more than 200 microns and wherein said coating layer has a thickness of not less than 50 microns.

17. A member according to claim 16, wherein said coating layer is applied on said sponge layer.

18. A member according to claim 16, wherein said charging member comprises a roller.

19. A member according to claim 16, wherein ten point average roughness of a surface of said charging member is not more than 50 microns.

20. A member according to claim 16, wherein said sponge layer is electrically conductive, and said coating layer comprises a resistance layer.

21. A member according to claim 16, wherein said coating layer has a thickness of not more than 500 microns.

22. A charging device, comprising:

a charging member contactable to a chargeable member to be charged to electrically charge the chargeable member, said charging member including:

a sponge layer; and a coating layer disposed between said sponge layer and the chargeable member;

wherein a cell diameter in a surface of said sponge layer coated with said coating layer is not more than 200 microns and wherein said coating layer has a thickness of not less than 50 microns.

23. A member according to claim 16, wherein said coating layer is contactable to the chargeable member.

24. A process cartridge detachably mountable to an image forming apparatus, said process cartridge comprising:

an image bearing member; and a charging member, contactable to said image bearing member, to electrically charge said image bearing member, said charging member including a sponge layer and a coating layer between said sponge layer and said image bearing member;

wherein a cell diameter in a surface of said sponge layer coated with said coating layer is not more than 200 microns and wherein said coating layer has a thickness of not less than 50 microns.

25. A process cartridge according to claim 24, further comprising developing means for developing said image bearing member with toner.

26. An image forming apparatus, comprising:

an image bearing member; and a charging member, contactable to said image bearing member, to electrically charge said image bearing member, said charging member including a sponge layer and a coating layer between said sponge layer and said image bearing member;

wherein a cell diameter in a surface of said sponge layer coated with said coating layer is not more than 200 microns and wherein said coating layer has a thickness of not less than 50 microns.

27. An apparatus according to claim 26, wherein said charging member is supplied with an oscillating voltage.

28. An apparatus according to claim 27, wherein the voltage is an AC-biased, DC voltage.

29. An apparatus according to either claim 27 or 28, wherein a peak-to-peak voltage of the oscillating voltage is not less than twice as high as a charge starting voltage for said image bearing member.

30. A charging device, comprising:

a charging member contactable to a chargeable member to be charged to electrically charge the chargeable member, said charging member being supplied with an oscillating voltage including:

a sponge layer; and a coating layer disposed between said sponge layer and the chargeable member;

wherein a cell diameter in a surface of said sponge layer coated with said coating layer is not more than 200 microns.

31. A device according to claim 30, wherein said coating layer is applied on said sponge layer.

32. A device according to claim 30, wherein said charging member comprises a roller.

33. A device according to claim 30, wherein the oscillating voltage is an AC-biased, DC voltage.

34. A device according to claim 30 or 33, wherein a peak-to-peak voltage of the oscillating voltage is not less than twice as high as a charge starting voltage for said image bearing member.

35. A device according to claim 33, wherein ten point average roughness of a surface of said charging member is not more than 50 microns.

36. A device according to claim 30, wherein said sponge layer is electrically conductive, and the coating layer comprises a resistance layer.

37. A device according to claim 30, wherein said coating layer has a thickness of not more than 500 microns.

38. A device according to claim 30, wherein said coating layer is contactable to the member to be charged.

39. A process cartridge detachably mountable to an image forming apparatus, comprising:

an image bearing member; and a charging member, contactable to said image bearing member, to electrically charge said image bearing member, said charging member being supplied with an oscillating voltage, said charging member including a sponge layer and a coating layer between said sponge layer and said image bearing member;

wherein a cell diameter in a surface of said sponge layer coated with said coating layer is not more than 200 microns.

40. A process cartridge according to claim 39, further comprising developing means for developing said image bearing member with toner.

41. An image forming apparatus, comprising:

an image bearing member; and a charging member, contactable to said image bearing member, to electrically charge said image bearing member, said charging member being supplied with an oscillating voltage, said charging member including a sponge layer and a coating layer between said sponge layer and said image bearing member;

wherein a cell diameter in a surface of said sponge layer coated with said coating layer is not more than 200 microns.

42. A charging member contactable to a chargeable member to be charged to electrically charge the chargeable member, said charging member comprising:

a sponge layer; and a coating layer disposed between said sponge layer and the chargeable member;

wherein a cell diameter in a surface of said sponge layer coated with said coating layer is not more than 200 microns wherein ten point average roughness of a surface of said charging member is not more than 50 microns.

43. A member according to claim 42, wherein said coating layer is applied on said sponge layer.

44. A member according to claim 42, wherein said charging member comprises a roller.

45. A member according to claim 42, wherein said sponge layer is electrically conductive, and the coating layer comprises a resistance layer.

46. A member according to claim 42, wherein said coating layer has a thickness of not more than 500 microns.

47. A member according to claim 42, wherein said coating layer is contactable to the chargeable member.

48. A charging device, comprising:

a charging member contactable to a chargeable member to be charged to electrically charge the chargeable member, said charging member including:

a sponge layer; and a coating layer disposed between said sponge layer and the chargeable member;

wherein a cell diameter in a surface of said sponge layer coated with said coating layer is not more than 200 microns wherein ten point average roughness of a surface of said charging member is not more than 50 microns.

49. A process cartridge detachably mountable to an image forming apparatus, said process cartridge comprising:

an image bearing member; and a charging member, contactable to said image bearing member, to electrically charge said image bearing member, said charging member including a sponge layer and a coating layer between said sponge layer and said image bearing member;

wherein a cell diameter in a surface of said sponge layer coated with said coating layer is not more than 200 microns wherein ten point average roughness of a surface of said charging member is not more than 50 microns.

50. A process cartridge according to claim 49, further comprising developing means for developing said image bearing member with toner.

51. An image forming apparatus, comprising:

an image bearing member; and a charging member, contactable to said image bearing member, to electrically charge said image bearing member, said charging member including a sponge layer and a coating layer between said sponge layer and said image bearing member;

wherein a cell diameter in a surface of said sponge layer coated with said coating layer is not more than 200 microns wherein ten point average roughness of a surface of said charging member is not more than 50 microns.

52. A charging member contactable to a chargeable member to be charged to electrically charge the chargeable member, said charging member, comprising:

a sponge layer; and a coating layer disposed between said sponge layer and the chargeable member;

wherein a cell diameter in a surface of said sponge layer coated with said coating layer is not more than 200 microns wherein said sponge layer is electrically conductive, and the coating layer is a resistance layer.

53. A member according to claim 52, wherein said coating layer is applied on said sponge layer.

54. A member according to claim 52, wherein said charging member comprises a roller.

55. A member according to claim 52, wherein said coating layer has a thickness of not more than 500 microns.

56. A member according to claim 52, wherein said coating layer is contactable to the chargeable member.

57. A charging device, comprising:

a charging member contactable to a chargeable member to be charged to electrically charge the chargeable member, said charging member including:

a sponge layer; and a coating layer disposed between said sponge layer and the chargeable member;

wherein a cell diameter in a surface of said sponge layer coated with said coating layer is not more than 200 microns wherein said sponge layer is electrically conductive, and the coating layer is a resistance layer.

58. A process cartridge detachably mountable to an image forming apparatus, said process cartridge comprising:

an image bearing member; and a charging member, contactable to said image bearing member, to electrically charge said image bearing member, said charging member including a sponge layer and a coating layer between said sponge layer and said image bearing member;

wherein a cell diameter in a surface of said sponge layer coated with said coating layer is not more than 200 microns wherein said sponge layer is electrically conductive, and the coating layer is a resistance layer.

59. A process cartridge according to claim 58, further comprising developing means for developing said image bearing member with toner.

60. An image forming apparatus, comprising:

an image bearing member; and a charging member, contactable to said image bearing member, to electrically charge said image bearing member, said charging member including a sponge layer and a coating layer between said sponge layer and said image bearing member;

wherein a cell diameter in a surface of said sponge layer coated with said coating layer is not more than 200 microns wherein said sponge layer is electrically conductive, and the coating layer is a resistance layer.

* * * * *

UNITED STATES PATENT AND TRADEMARK OFFICE

CERTIFICATE OF CORRECTION

PATENT NO. : 5,390,007

DATED : February 14, 1995

INVENTOR(S) : HARUMI KUGOH et al

It is certified that error appears in the above-indentified patent and that said Letters Patent is hereby corrected as shown below:

[57] ABSTRACT

Line 3, "it" should read --it,--.

COLUMN 2:

Line 3, "foam" should read --form--; and
Line 8, "foam" should read --form--

COLUMN 3:

Line 1, "a" should read --an--.

COLUMN 4:

Line 6, "charged." should read --charged,--; and
Line 59, "and" should be deleted.
Line 60, "rubber)." should read --rubber),--.

COLUMN 6:

Line 28, "images." should read --images,--; and
Line 40, "as" should read --of--.

COLUMN 7:

Line 55, "11a" should read --11a--.

UNITED STATES PATENT AND TRADEMARK OFFICE

CERTIFICATE OF CORRECTION

PATENT NO. : 5,390,007 Page 2 of 2

DATED : February 14, 1995

INVENTOR(S) : HARUMI KUGOH et al

It is certified that error appears in the above-indentified patent and that said Letters Patent is hereby corrected as shown below:

COLUMN 8:

Line 11, "peak-lo-peak" should read --peak-to-peak--; and
Line 40, "if" should read --is--.

COLUMN 9:

Line 43, "(Amended)" should be deleted.

Signed and Sealed this

Sixth Day of June, 1995

Bruce Lehman

*Attest:*

BRUCE LEHMAN

*Attesting Officer*

*Commissioner of Patents and Trademarks*